United States Patent [19]

Martin et al.

[11] Patent Number: 4,640,985

[45] Date of Patent: Feb. 3, 1987

[54] SNAP-FITTING TRANSFORMER TERMINAL COVER

[75] Inventors: Frank J. Martin; Murray Hartman; Randy Saunders, all of Ontario, Canada

[73] Assignee: Schlumberger Canada Limited, Toronto, Canada

[21] Appl. No.: 727,877

[22] Filed: Apr. 26, 1985

[51] Int. Cl.[4] ..... H01R 13/44; H01F 27/04

[52] U.S. Cl. ..... 174/138 F; 336/107; 339/198 J

[58] Field of Search ..... 174/5 R, 67, 138 F; 336/98, 105, 107; 310/71; 324/110; 339/36, 198 J; 361/372, 373, 374, 375

[56] References Cited

U.S. PATENT DOCUMENTS

| | | | |
|---|---|---|---|
| 1,494,404 | 5/1924 | Bailey | 361/372 |
| 1,647,566 | 11/1927 | Gillen | 361/372 X |
| 1,692,875 | 11/1928 | Vannini | 361/373 |
| 1,988,733 | 1/1935 | Helgason | 336/107 X |
| 3,283,062 | 11/1966 | D'Entremont | 174/138 F |
| 3,491,327 | 1/1970 | Tait et al. | 174/67 X |
| 3,646,582 | 2/1972 | Van Alphen et al. | 336/107 X |

FOREIGN PATENT DOCUMENTS

| | | | |
|---|---|---|---|
| 413919 | 12/1966 | Switzerland | 174/138 F |

OTHER PUBLICATIONS

"Instrument Transformers–Bulletin 803A", May 1982, Sangamo Weston–Schlumberger, 2 pages.

"Instrument Transformers–Bulletin 807", Dec. 1982, Sangamo Weston–Schlumberger, 2 pages.

*Primary Examiner*—Laramie E. Askin

*Attorney, Agent, or Firm*—Dale Gaudier

[57] ABSTRACT

A snap-fitting cover assembly for the terminal block (12) of an electrical transformer (10) comprises a backing plate (18) having apertures (20) for receiving terminals (14) of the transformer and adapted to be mounted against the terminal block (12). The width of the backing plate 18) is slightly greater than the width of the terminal block (12) so that opposite side portions (A) of the plate (18) extend beyond the block. A cover (28) adapted to fit over the backing plate (18) and block (12) has a pair of inwardly extending ears (26) that snap fit around the extending portions of the backing plate (18). With the backing plate (18) secured to the transformer terminals (14) by nuts (24), the cover (28) is retained to the terminal block (12) by a seal wire (34) extending through the cover (28) and behind the plate (18).

5 Claims, 6 Drawing Figures

SNAP-FITTING TRANSFORMER TERMINAL COVER

TECHNICAL FIELD

This invention relates generally to electrical transformer terminal block cover assemblies, and more particularly, toward a cover that snap fits to the terminal block of a transformer and is retained by a seal wire.

BACKGROUND ART

Each house transformer of a commercial power utility company has a pair of medium voltage, secondary terminals that preferably should be covered or sealed for safety. The cover should have no openings through which customers' fingers can be inserted, should be easy to install by utility company personnel but be customer tamper resistant. The cover should also be easily and economically manufactured.

An object of this invention, therefore, is to provide a transformer terminal cover that is easily installed by utility company personnel, but difficult to remove or access by a customer.

A further object is to provide a terminal cover that is easily and economically manufactured.

SUMMARY OF THE INVENTION

The above and other objects of the invention are satisfied, in accordance with the invention, by a snap-fitting cover assembly for the terminal block of an electrical transformer, comprising a backing plate having apertures for receiving the transformer terminals and adapted to be mounted against the terminal block by terminal nuts. The backing plate is slightly wider than the terminal block so that opposite side portions of the plate extend slightly beyond the ends of the block. A cover that fits over the terminal block and backing plate has a pair of inwardly extending ears that snap fit around the extending portions of the plate. A wire seal that extends through the cover behind the backing plate, within a groove formed in the terminal block, secures the cover to the transformer.

The cover assembly is preferably used for covering the secondary terminals either before they are put into service or after wiring connections are made to the secondary terminals by providing cutouts in the cover through which the wiring extends.

Still other objects and advantages of the present invention will become readily apparent to those skilled in this art from the following detailed description, wherein we have shown and described only the preferred embodiment of the invention, simply by way of illustration of the best mode contemplated by us of carrying out our invention. As will be realized, the invention is capable of other and different embodiments, and its several details are capable of modifications in various obvious respects, all without departng from the invention. Accordingly, the drawing and description are to be regarded as illustrative in nature, and not as restrictive.

BEST MODE FOR PRACTICING THE INVENTION

Figure 1:
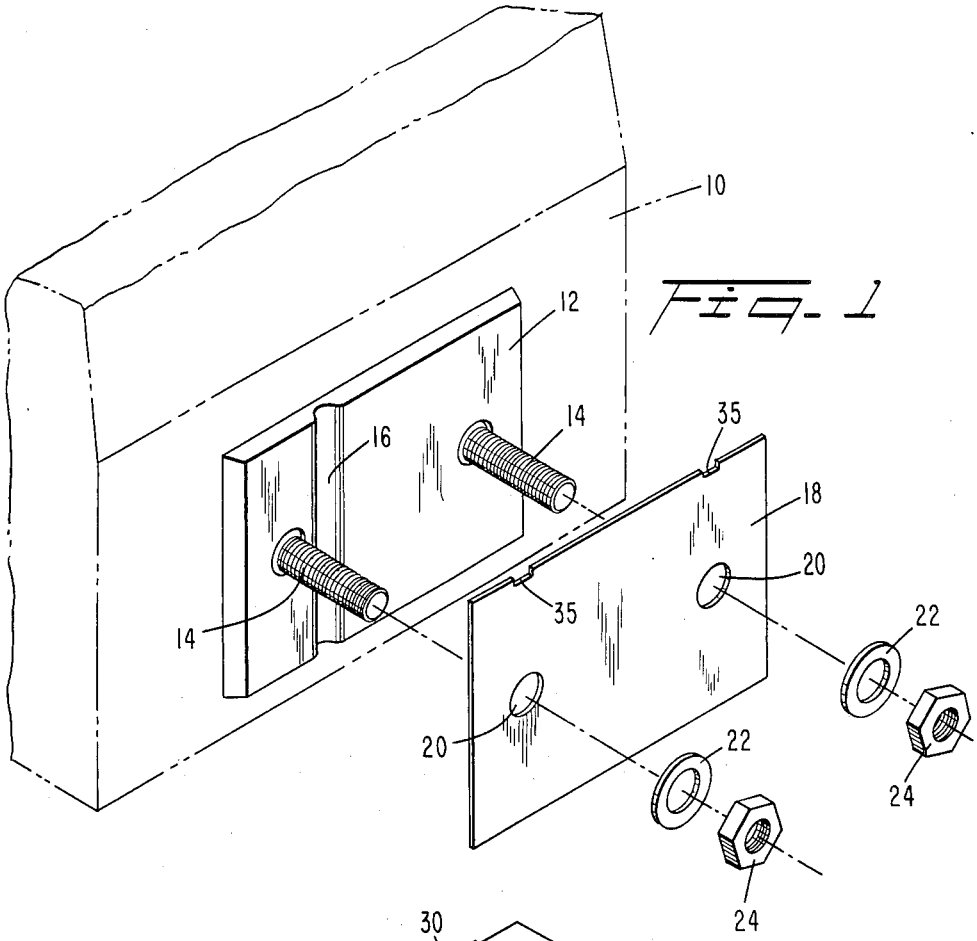
FIG. 1 is an exploded view of the terminal block, backing plate and fastener nuts.

With reference to FIG. 1, a transformer 10, shown in phantom lines, is formed with a conventional molded terminal block 12 from which extends a pair of threaded, medium voltage, secondary terminals 14. A groove 16 is located in the block 12 adjacent one of the secondary terminals 14.

A backing plate 18, formed of plastic or other electrically insulating material, has a pair of apertures 20 in positions corresponding to the positions of secondary terminals 14. The backing plate 18 is mounted on screw terminals 14 and secured against block 12 by washers 22 and nuts 24, as shown in FIG. 5.

Figure 5:
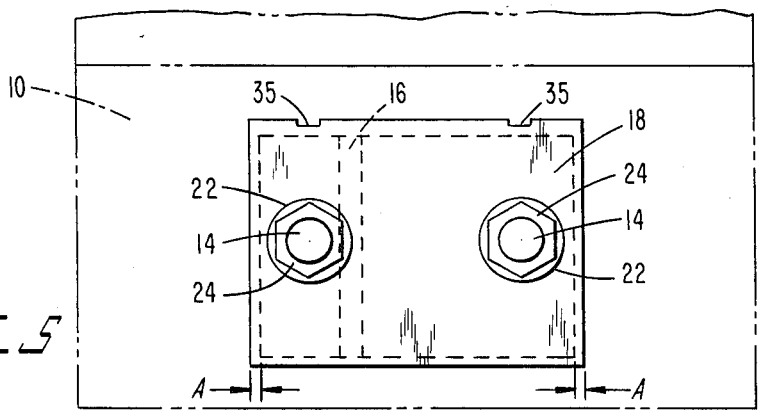
FIG. 5 is a front view of the backing plate mounted on a terminal block.
Figure 6:
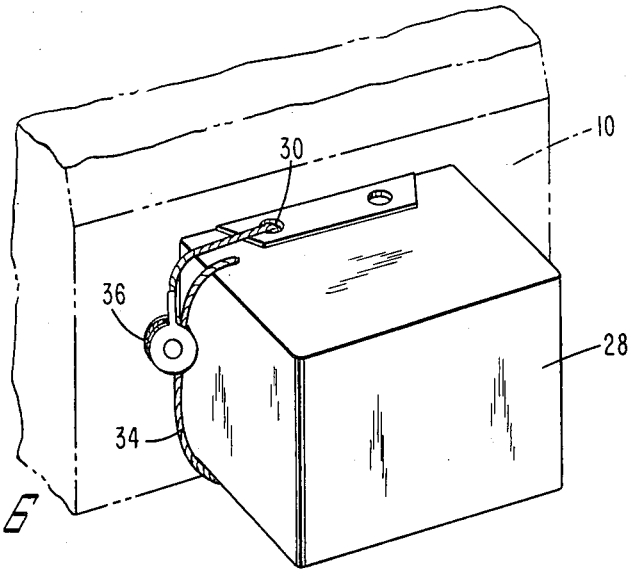
FIG. 6 is a perspective view of the cover secured to the transformer terminal block by a wire seal.

The width (long dimension) of backing plate 18 is slightly larger than the width of block 12, forming extended regions A as shown in FIG. 5. Regions A establish retaining lips for a pair of corresponding ears 26 integrally formed on the inner surface of terminal block cover 28, as shown in FIG. 3.

Figure 3:
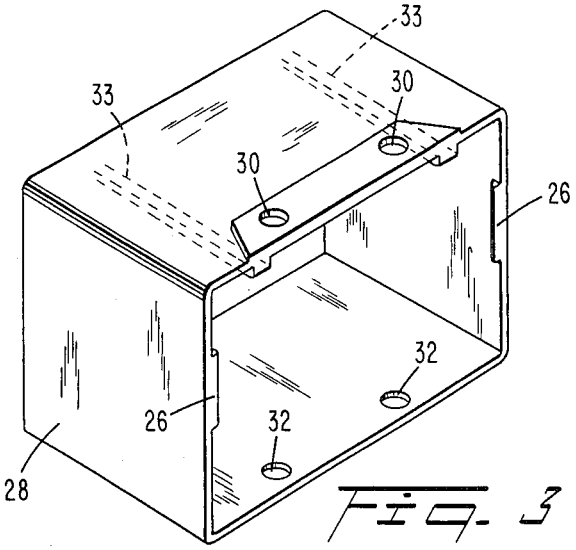
FIG. 3 is an opposite perspective view of the cover.

The cover 28, which preferably is formed of an impact resistant plastic material, has apertures 30 and 32 respectively on the upper and lower walls of the cover, and a pair of stiffener ribs 31 on the inner surface of the upper wall, as shown in FIG. 3. The position of groove 16 in terminal block 12 is in registration with one of the apertures 30, 32 in the cover 28, to seat a seal wire 34, described below. A pair of notches 35 in backing plate 18 accommodate ribs 33 to help retain the cover in proper alignment on the terminal block 12.

Figure 4:
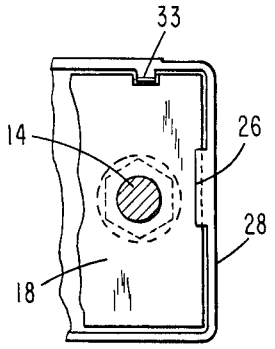
FIG. 4 is a rear view of a portion of the cover and backing plate, showing the operation of the snap-fitting ears of the cover.

The cover 28 is somewhat resilient, to enable ears 26 to "snap fit" around the backing plate 18, with the ears retained behind the two extending regions A, A of the plate, as shown in FIG. 4.

With the cover 28 mounted to backing plate 18, a conventional seal wire 34 has one end threaded through apertures 30, 32 of the cover 28, behind backing plate 18 and within groove 16. The ends of the seal wire 34 are secured together by lead end seal 36, completing the cover assembly.

Figure 2:
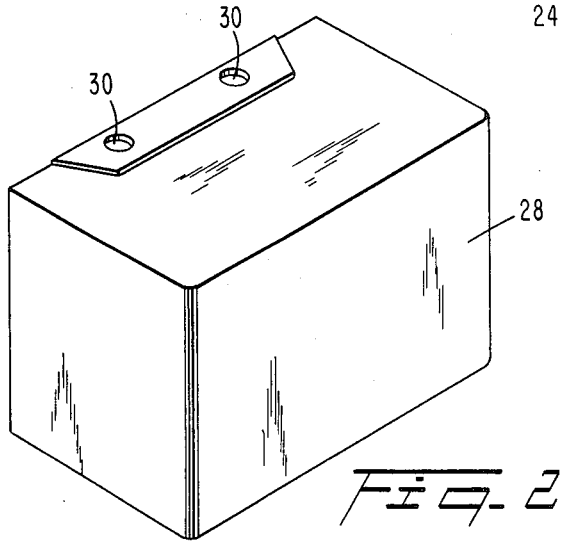
FIG. 2 is a perspective view of the snap-fitting, terminal block cover.

It is to be emphasized that the particular configuration of the cover with its apertures 30, 32 and terminal block 12 is conventional. Obviously, other configurations can be incorporated. For example, although two pairs of apertures in cover 28 are shown in FIG. 2 since that cover configuration is an "industry standard", only one aperture 30 and one aperture 32 need be provided. Furthermore, the particular locations of the stiffening ribs 33 on cover 28 can be modified or the ribs may be eliminated within the spirit of the invention.

In this disclosure, there is shown and described only the preferred embodiment of the inventon, but as aforementioned, it is to be understood that the invention is capable of use in various other combinations and environments and is capable of changes or modifications within the scope of the inventive concept as expressed herein.

We claim:

1. A snap-fitting cover assembly for use with an electrical transformer of the type having a molded terminal block with secondary terminals projecting outwardly therefrom, comprising:

a backing plate having apertures for receiving said secondary terminals of the transformer and adapted to be mounted against the terminal block, peripheral edges of the backing plate dimensioned to extend slightly beyond opposite sides of the terminal block;

means for securing the backing plate to the terminal block;

a cover adapted to fit around the terminal block and backing plate, including means for snap-fitting the cover to the peripheral edges of the backing plate; and means for securing the cover to said backing plate.

2. The cover assembly of claim 1, wherein said snap-fitting means includes inwardly extending ears on the cover.

3. The cover assembly of claim 2, wherein said ears are integrally formed on opposite sidewalls of said cover at an open end thereof.

4. The cover assembly of claim 1, wherein said terminal block includes a groove formed therein, and said cover securing means includes a wire seal for extending through the cover behind said backing plate, within said groove.

5. The cover assembly of claim 1, wherein said backing plate securing means includes nut fasteners for threading onto said transformer terminals.

* * * * *